US011830433B2

(12) United States Patent
Dong

(10) Patent No.: US 11,830,433 B2
(45) Date of Patent: Nov. 28, 2023

(54) DRIVE CIRCUIT, DRIVE METHOD, DISPLAY PANEL, AND DISPLAY DEVICE

(71) Applicant: BOE Technology Group Co., Ltd., Beijing (CN)

(72) Inventor: Tian Dong, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 5 days.

(21) Appl. No.: 17/626,460

(22) PCT Filed: Apr. 9, 2021

(86) PCT No.: PCT/CN2021/086093
§ 371 (c)(1),
(2) Date: Jan. 11, 2022

(87) PCT Pub. No.: WO2021/227725
PCT Pub. Date: Nov. 18, 2021

(65) Prior Publication Data

US 2022/0284862 A1 Sep. 8, 2022

(30) Foreign Application Priority Data

May 13, 2020 (CN) ..... 202010400264.1

(51) Int. Cl.
*G09G 3/3266* (2016.01)

(52) U.S. Cl.
CPC ... *G09G 3/3266* (2013.01); *G09G 2300/0842* (2013.01); *G09G 2310/0286* (2013.01); *G09G 2320/0233* (2013.01)

(58) Field of Classification Search
None
See application file for complete search history.

(56) References Cited

U.S. PATENT DOCUMENTS 6,859,193 B1 2/2005 Yumoto
2003/0142052 A1 7/2003 Matsumoto
(Continued)

FOREIGN PATENT DOCUMENTS

CN 1435805 A 8/2003
CN 1658263 A 8/2005
(Continued)

OTHER PUBLICATIONS

CN202010400264.1 first office action.

*Primary Examiner* — Chineyere D Wills-Burns
*Assistant Examiner* — Amen W Bogale
(74) *Attorney, Agent, or Firm* — IPro, PLLC

(57) ABSTRACT

A drive circuit, a drive method, a display panel, and a display device. The drive circuit includes: a drive transistor (M0), a first pole of the drive transistor (M0) being electrically connected to a first power supply end (ELVDD), a second pole of the drive transistor (M0) being electrically connected to an element to be driven (L); a first control circuit (1), a first end of the first control circuit (1) being electri-cally connected to a data detection end, a control end of the first control circuit (1) being electrically connected to a control signal end (CS); a stabilizing capacitor (CLC), a first pole of the stabilizing capacitor (CLC) being electrically connected to a second end of the first control circuit (1), the second pole of the stabilizing capacitor (CLC) being electrically connected to the first power supply end (ELVDD): a second control circuit (2).

10 Claims, 10 Drawing Sheets

(56) References Cited

U.S. PATENT DOCUMENTS

| | | | | |
|---|---|---|---|---|
| 2005/0140605 | A1* | 6/2005 | Jung | G09G 3/3233 345/76 |
| 2006/0139279 | A1 | 6/2006 | Yamazaki et al. | |
| 2011/0279437 | A1 | 11/2011 | Komiya et al. | |
| 2012/0182281 | A1 | 7/2012 | Yamamoto et al. | |
| 2012/0293479 | A1* | 11/2012 | Han | H04N 13/341 345/212 |
| 2014/0340290 | A1 | 11/2014 | Ono | |
| 2017/0132974 | A1* | 5/2017 | Matsueda | G09G 3/3233 |
| 2017/0294162 | A1 | 10/2017 | Hu et al. | |
| 2017/0365219 | A1 | 12/2017 | Lee et al. | |
| 2018/0082637 | A1* | 3/2018 | Zhang | G09G 3/3258 |
| 2019/0043421 | A1* | 2/2019 | Yang | G09G 3/3291 |
| 2019/0057648 | A1 | 2/2019 | Xu | |
| 2019/0287464 | A1 | 9/2019 | Park et al. | |
| 2019/0393291 | A1* | 12/2019 | Jeon | H10K 59/131 |
| 2021/0097937 | A1 | 4/2021 | Wang et al. | |
| 2021/0174739 | A1 | 6/2021 | Lu et al. | |
| 2022/0375408 | A1* | 11/2022 | Dong | G09G 3/3241 |

FOREIGN PATENT DOCUMENTS

| | | | |
|---|---|---|---|
| CN | 101650916 | A | 2/2010 |
| CN | 102243839 | A | 11/2011 |
| CN | 105336292 | A | 2/2016 |
| CN | 105575320 | A | 5/2016 |
| CN | 106875893 | A | 6/2017 |
| CN | 107516491 | A | 12/2017 |
| CN | 107863067 | A | 3/2018 |
| CN | 108847186 | A | 11/2018 |
| CN | 109903724 | A | 6/2019 |
| CN | 110349997 | A | 10/2019 |
| CN | 110767163 | A | 2/2020 |
| CN | 110910825 | A | 3/2020 |
| CN | 111445856 | A | 7/2020 |
| EP | 3540720 | A3 | 1/2020 |
| JP | 2006106786 | A | 4/2006 |
| KR | 20120074422 | A | 7/2012 |

* cited by examiner

DRIVE CIRCUIT, DRIVE METHOD, DISPLAY PANEL, AND DISPLAY DEVICE

CROSS-REFERENCE TO RELATED APPLICATIONS

This application is a US National Stage of International Application No. PCT/CN2021/086093, filed on Apr. 9, 2021, which claims the priority of the Chinese patent application No. 202010400264.1 filed to the China Patent Office on May 13, 2020, and entitled "DRIVE CIRCUIT, DRIVE METHOD, DISPLAY PANEL, AND DISPLAY APPARATUS", of which the entire contents are incorporated herein by reference.

FIELD

The present disclosure relates to the technical field of display, in particular to a drive circuit, a drive method, a display panel and a display apparatus.

BACKGROUND

An organic light emitting diode (OLED) display is one of hotspots in the field of research of current flat panel displays, and compared with a liquid crystal display (LCD), the OLED display has the advantages of being low in energy consumption, low in production cost, capable of emitting light automatically, wide in viewing angle, high in response speed and the like. A drive circuit for controlling a light emitting device to emit light is the core technical content of the OLED display, and has important research significance. However, due to the leakage current characteristic of transistors in the drive circuit, the voltage of a gate electrode of a drive transistor is unstable, consequently, light emission is unstable, and the brightness is not uniform.

SUMMARY

A drive circuit provided by embodiments of the present disclosure, includes:

a drive transistor, where a first electrode of the drive transistor is electrically connected with a first power supply end, and a second electrode of the drive transistor is electrically connected with a device to be driven;

a first control circuit, where a first end of the first control circuit is electrically connected with a data detection end, and a control end of the first control circuit is electrically connected with a control signal end; and the first control circuit is configured to conduct the data detection end and a second end of the first control circuit in response to a signal of a control signal end;

a voltage stabilizing capacitor, where a first electrode of the voltage stabilizing capacitor is electrically connected with the second end of the first control circuit, and a second electrode of the voltage stabilizing capacitor is electrically connected with the first power supply end; and a second control circuit, where a first end of the second control circuit is electrically connected with the first electrode of the voltage stabilizing capacitor, a second end of the second control circuit is electrically connected with a gate electrode of the drive transistor, and a control end of the second control circuit is electrically connected with the control signal end; and the second control circuit is configured to conduct the first electrode of the voltage stabilizing capacitor and the gate electrode of the drive transistor in response to a signal of a control signal end.

In some examples, in the embodiments of the present disclosure, the control signal end includes: a scanning signal end;

the first control circuit includes a first transistor; where a first electrode of the first transistor is electrically connected with the data detection end, a gate electrode of the first transistor is electrically connected with the scanning signal end, and a second electrode of the first transistor is electrically connected with the first electrode of the voltage stabilizing capacitor; and the second control circuit includes a second transistor; where a first electrode of the second transistor is electrically connected with the first electrode of the voltage stabilizing capacitor, a gate electrode of the second transistor is electrically connected with the scanning signal end, and a second electrode of the second transistor is electrically connected with the gate electrode of the drive transistor.

In some examples, in the embodiments of the present disclosure, the control signal end further includes: a detection signal end;

the first control circuit further includes a third transistor; where a first electrode of the third transistor is electrically connected with the data detection end, a gate electrode of the third transistor is electrically connected with the detection signal end, and a second electrode of the third transistor is electrically connected with the first electrode of the voltage stabilizing capacitor; and the second control circuit further includes a fourth transistor; where a first electrode of the fourth transistor is electrically connected with the first electrode of the voltage stabilizing capacitor, a gate electrode of the fourth transistor is electrically connected with the detection signal end, and a second electrode of the fourth transistor is electrically connected with the gate electrode of the drive transistor.

In some examples, in the embodiments of the present disclosure, the control signal end includes: the detection signal end; and the drive circuit further includes:

a fifth transistor, where a gate electrode of the fifth transistor is electrically connected with the detection signal end, and a first electrode of the fifth transistor is electrically connected with the gate electrode of the drive transistor; and a sixth transistor, where a gate electrode of the sixth transistor is electrically connected with the detection signal end, a first electrode of the sixth transistor is electrically connected with a second electrode of the fifth transistor, and a second electrode of the sixth transistor is electrically connected with the second electrode of the drive transistor.

In some examples, in the embodiments of the present disclosure, the drive circuit further includes:

a storage capacitor, where a first electrode of the storage capacitor is electrically connected with the gate electrode of the drive transistor, and a second electrode of the storage capacitor is electrically connected with the first power supply end.

A display panel provided by embodiments of the present disclosure, includes:

a base substrate;

a plurality of sub-pixels, located on the base substrate, where at least one of the plurality of sub-pixels includes a light emitting device and the drive circuit above; where a second electrode of a drive transistor in the drive circuit is electrically connected with a first electrode of the light emitting device;

a plurality of control signal lines, located on the base substrate, where control signal ends of drive circuits in one row of sub-pixels is correspondingly and electrically connected with at least one of the control signal lines; and a plurality of data detection lines, located on the base substrate, where data detection ends of drive circuits in one column of sub-pixels is correspondingly and electrically connected with at least one of the data detection lines.

In some examples, in the embodiments of the present disclosure, the plurality of control signal lines include: scanning signal lines; and scanning signal ends of the drive circuits in one row of sub-pixels is correspondingly and electrically connected with one of the scanning signal lines.

In some examples, in the embodiments of the present disclosure, the plurality of control signal lines further include: detection signal lines; and detection signal ends of the drive circuits in one row of sub-pixels is correspondingly and electrically connected with one of the detection signal lines.

In some examples, in the embodiments of the present disclosure, the display panel further includes:

a reset signal line;

an initialization signal line; and a plurality of seventh transistors, where one data detection line corresponds to one seventh transistor; where gate electrodes of the plurality of seventh transistors are electrically connected with the reset signal line, first electrodes of the plurality of seventh transistors are electrically connected with the initialization signal line, and a second electrode of each of the plurality of seventh transistors is electrically connected with a corresponding data detection line.

In some examples, in the embodiments of the present disclosure, the display panel further includes:

a first power line, electrically connected with a first power supply end of the drive circuit;

a second power line, electrically connected with a second electrode of the light emitting device; and a power management circuit, including: a first power generation circuit, a second power generation circuit, an eighth transistor and a ninth transistor; where the first power generation circuit is configured to generate a first voltage loaded to the first power supply end, and the second power generation circuit is configured to generate a second voltage loaded to a second power supply end;

where an output end of the first power generation circuit is electrically connected with the first power line;

a gate electrode of the eighth transistor is electrically connected with a first selection signal end, a first electrode of the eighth transistor is electrically connected with the output end of the first power generation circuit, and a second electrode of the eighth transistor is electrically connected with the second power line; and a gate electrode of the ninth transistor is electrically connected with a second selection signal end, a first electrode of the ninth transistor is electrically connected with an output end of the second power generation circuit, and a second electrode of the ninth transistor is electrically connected with the second power line.

A display apparatus provided by embodiments of the present disclosure includes the above display panel.

A drive method of the above drive circuit provided by embodiments of the present disclosure, includes: a display period and a detection period;

the display period includes a data writing period and a light emitting period;

where in the data writing period, the first control circuit conducts a data detection end and a second end of the first control circuit in response to a signal of a control signal end; and a second control circuit conducts a first electrode of a voltage stabilizing capacitor and a gate electrode of a drive transistor in response to a signal of a second control signal end; and in the light emitting period, the drive transistor generates a drive current and provides the drive current to a device to be driven, to drive the device to be driven to emit light;

where the detection period includes a reset period, a charging period and a sampling period;

in the reset period, an initialization signal is loaded to the data detection end to reset the data detection end; and the first control circuit conducts the data detection end and the second end of the first control circuit in response to the signal of the control signal end, and the second control circuit conducts the first electrode of the voltage stabilizing capacitor and the gate electrode of the drive transistor in response to the signal of the control signal end, to reset the drive transistor;

in the charging period, the data detection end is in a floating state, and the first control circuit conducts the data detection end and the second end of the first control circuit in response to the signal of the control signal end; the second control circuit conducts the first electrode of the voltage stabilizing capacitor and the gate electrode of the drive transistor in response to the signal of the control signal end; and a fifth transistor and a sixth transistor are conducted to charge the data detection end; and in the sampling period, a voltage after the data detection end is charged is collected.

DETAILED DESCRIPTION OF THE EMBODIMENTS

Figure 1:
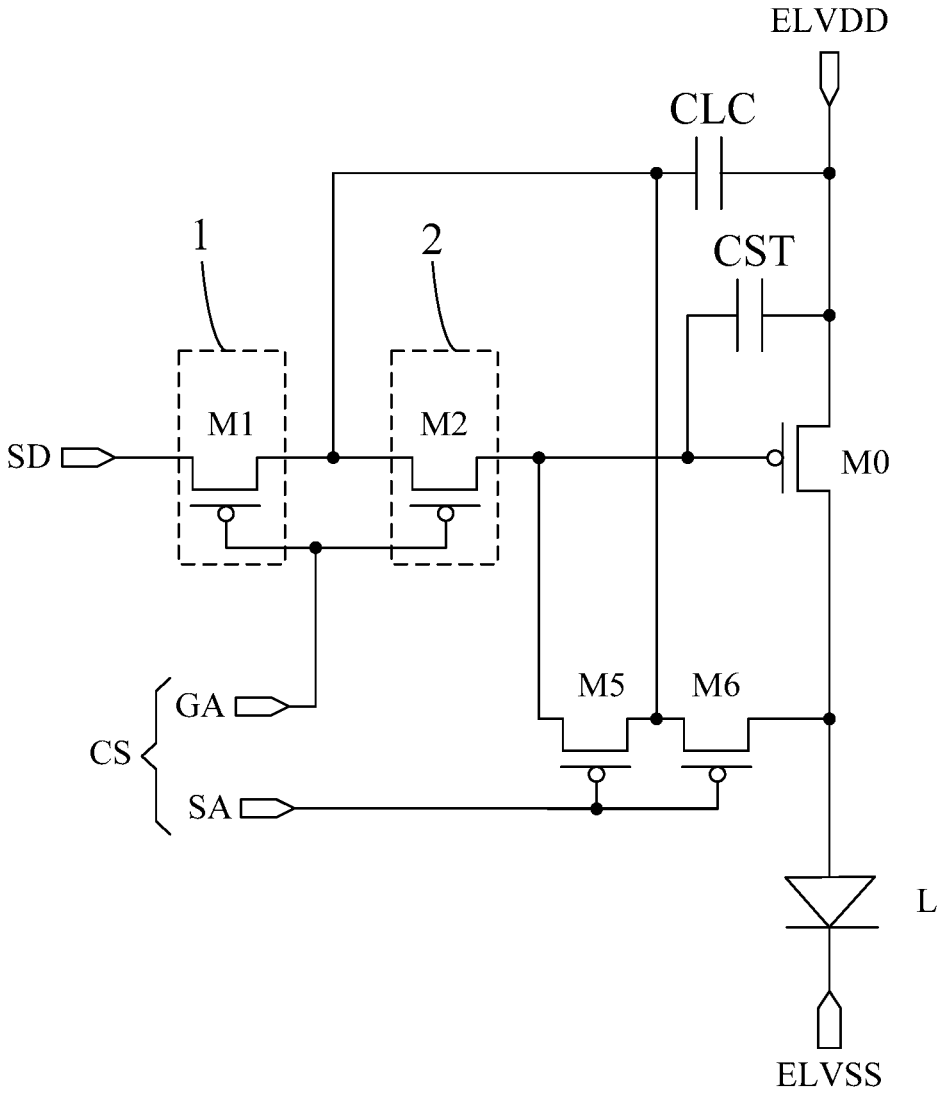
FIG. 1 is a schematic structural diagram of some drive circuits in embodiments of the present disclosure.

In order to make the objective, technical solutions and advantages of the embodiments of the present disclosure clearer, the technical solutions of the embodiments of the present disclosure will be described clearly and completely with reference to the drawings of the embodiments of the present disclosure. Obviously, the described embodiments are part of the embodiments of the present disclosure, but not all the embodiments. The embodiments in the present disclosure and features in the embodiments may be mutually combined in the case of no conflict. On the basis of the described embodiments of the present disclosure, all other embodiments obtained by a person of ordinary skill in the art without inventive efforts fall within the protection scope of the present disclosure.

Unless otherwise defined, the technical or scientific terms used by the present disclosure should be general meaning understood by those of ordinary skill in the art to which the present disclosure belongs. The words "first", "second" and the like used in the present disclosure do not indicate any order, quantity or importance, but are only used to distinguish different components. Similar words such as "comprise" or "include" mean that elements or objects appearing in front of the word encompass elements or objects listed behind the word and their equivalents, without excluding other elements or objects. The word "connection" or "coupling" and the like is not restricted to physical or mechanical connection, but may include electrical connection, whether direct or indirect.

It should be noted that the size and shapes of all graphs in the drawings do not reflect the true scale, and only intend to illustrate the content of the present disclosure. The same or similar reference numbers represent the same or similar elements or elements with the same or similar functions from beginning to end.

As shown in FIG. 1, some drive circuits provided by embodiments of the present disclosure may each include:

- a drive transistor M0, where a first electrode of the drive transistor M0 is electrically connected with a first power supply end ELVDD, and a second electrode of the drive transistor M0 is electrically connected with a device to be driven;
- a first control circuit 1, where a first end of the first control circuit 1 is electrically connected with a data detection end SD, and a control end of the first control circuit 1 is electrically connected with a control signal end CS; and the first control circuit 1 is configured to conduct the data detection end SD and a second end of the first control circuit 1 in response to a signal of a control signal end CS;
- a voltage stabilizing capacitor CLC, where a first electrode of the voltage stabilizing capacitor CLC is electrically connected with the second end of the first control circuit 1; and
- a second control circuit 2, where a first end of the second control circuit 2 is electrically connected with a second electrode of the voltage stabilizing capacitor CLC, a second end of the second control circuit 2 is electrically connected with a gate electrode of the drive transistor M0, and a control end of the second control circuit 2 is electrically connected with the control signal end CS; and the second control circuit 2 is configured to conduct the second electrode of the voltage stabilizing capacitor CLC and the gate electrode of the drive transistor M0 in response to a signal of a control signal end CS.

According to the drive circuit provided by the embodiments of the present disclosure, the first control circuit is configured to conduct the data detection end and the second end of the first control circuit in response to the signal of the control signal end; and the second control circuit is configured to conduct the first electrode of the voltage stabilizing capacitor and the gate electrode of the drive transistor in response to the signal of the control signal end. Moreover, by arranging the voltage stabilizing capacitor, a leakage current of the transistor can be stored in the voltage stabilizing capacitor by utilizing a charge storage effect of the voltage stabilizing capacitor, so that a voltage difference between the first electrode of the voltage stabilizing capacitor and the data detection end can be reduced, and the leakage current is further reduced. Moreover, a voltage of the first electrode of the voltage stabilizing capacitor and a voltage of the gate electrode of the drive transistor may be made approximately the same in a light emitting period, so that the voltage difference between the first electrode of the voltage stabilizing capacitor and the gate electrode of the drive transistor is approximately zero, the influence of the leakage current on the voltage of the gate electrode of the drive transistor can be further reduced, and the voltage stability of the gate electrode of the drive transistor is further improved.

In specific implementation, in the embodiments of the present disclosure, as shown in FIG. 1, the control signal end CS includes: a scanning signal end GA. The first control circuit 1 includes a first transistor M1. A first electrode of the first transistor M1 is electrically connected with the data detection end SD, a gate electrode of the first transistor M1 is electrically connected with the scanning signal end GA, and a second electrode of the first transistor M1 is electrically connected with the first electrode of the voltage stabilizing capacitor CLC. Moreover, the second control circuit 2 includes a second transistor M2. A first electrode of the second transistor M2 is electrically connected with the first electrode of the voltage stabilizing capacitor CLC, a gate electrode of the second transistor M2 is electrically connected with the scanning signal end GA, and a second electrode of the second transistor M2 is electrically connected with the gate electrode of the drive transistor M0.

In specific implementation, in the embodiments of the present disclosure, as shown in FIG. 1, the control signal end CS further includes: a detection signal end SA. Moreover, the drive circuit further includes: a fifth transistor M5 and a sixth transistor M6. A gate electrode of the fifth transistor M5 is electrically connected with the detection signal end SA, and a first electrode of the fifth transistor M5 is electrically connected with the gate electrode of the drive transistor M0. A gate electrode of the sixth transistor M6 is electrically connected with the detection signal end SA, a first electrode of the sixth transistor M6 is electrically connected with a second electrode of the fifth transistor M5, and a second electrode of the sixth transistor M6 is electrically connected with the second electrode of the drive transistor M0.

In specific implementation, in the embodiments of the present disclosure, as shown in FIG. 1, the drive circuit further includes: a storage capacitor CST. A first electrode of the storage capacitor CST is electrically connected with the gate electrode of the drive transistor M0, and a second electrode of the storage capacitor CST is electrically connected with the first power supply end ELVDD.

In specific implementation, as shown in FIG. 1, the drive transistor M0 may be a P-type transistor, where a first electrode of the drive transistor M0 is a source electrode thereof, a second electrode of the drive transistor M0 is a drain electrode thereof, and when the drive transistor M0 is in a saturated state, a drive signal transmitted from the source electrode to the drain electrode of the drive transistor M0 may be generated. Certainly, the drive transistor M0 may also be an N-type transistor, where a first electrode of the drive transistor M0 is a drain electrode thereof, a second electrode of the drive transistor M0 is a source electrode thereof, and when the drive transistor M0 is in a saturated state, a drive signal transmitted from the drain electrode to the source electrode of the drive transistor M0 may be generated.

In specific implementation, the device to be driven may be a light emitting device, and the drive signal may be used as a drive current for driving the light emitting device to emit light. Certainly, in practical application, the device to be driven may also be set to be other devices, which is not limited here. Illustration is made below by taking an example that the device to be driven is the light emitting device.

In specific implementation, in the embodiments of the present disclosure, a first electrode of the light emitting device is electrically connected with the second electrode of the drive transistor M0, and a second electrode of the light emitting device is electrically connected with a second power supply end ELVSS. The first electrode of the light emitting device is a positive electrode thereof, and the second electrode is a negative electrode thereof. In addition, the light emitting device is generally a light emitting diode, for example, the light emitting device may include: at least one of a micro light emitting diode (Micro LED), an organic light emitting diode (OLED) or a quantum dot light emitting diode (QLED). In addition, a general light emitting device has a light emitting threshold voltage, and emits light when a voltage across two ends of the light emitting device is greater than or equal to the light emitting threshold voltage. In practical application, the specific structure of the light emitting device may be designed and determined according to the practical application environment, which is not limited here.

The specific structure of each circuit in the drive circuit provided by the embodiments of the present disclosure is only explained by way of example, and during specific implementation, the specific structure of the circuit is not limited to the structure provided by the embodiments of the present disclosure, and can also be other structures known by those skilled in the art, and all the structures are within the protection scope of the present disclosure, which is not specifically limited here.

In some examples, in order to reduce preparation processes, in specific implementation, in the embodiments of the present disclosure, as shown in FIG. 1, all the transistors may be P-type transistors. Certainly, all the transistors may also be N-type transistors, which can also be designed and determined according to the actual application environment, which is not limited here.

Further, in specific implementation, in the embodiments of the present disclosure, a P-type transistor is cut off under the action of a high-level signal and is conducted under the action of a low-level signal. An N-type transistor is conducted under the action of a high-level signal and is cut off under the action of a low-level signal.

It needs to be noted that the transistor mentioned in the embodiments of the present disclosure may be a thin film transistor (TFT) and may also be a metal oxide semiconductor (MOS), which is not limited here.

In specific implementation, according to the type of the transistor and the signal of the gate electrode of the transistor, the first electrode of the transistor is used as the source electrode thereof, and the second electrode is used as the drain electrode thereof; or, conversely, the first electrode of the transistor is used as the drain electrode thereof, and the second electrode of the transistor is used as the source electrode thereof, which can be designed and determined according to the actual application environment and is not specifically distinguished here.

In specific implementation, in the embodiments of the present disclosure, a voltage Vdd of the first power supply end ELVDD is generally a positive value, and a voltage Vss of the second power supply end ELVSS is generally grounded or is a negative value. In practical application, specific values of the voltage Vdd of the first power supply end ELVDD and the voltage Vss of the second power supply end ELVSS can be designed and determined according to the actual application environment, which is not limited here.

Figure 2A:
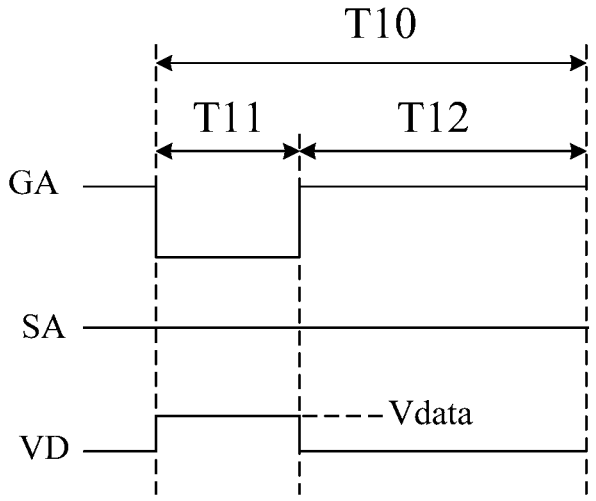
FIG. 2A is some signal sequence diagrams in embodiments of the present disclosure.
Figure 2B:
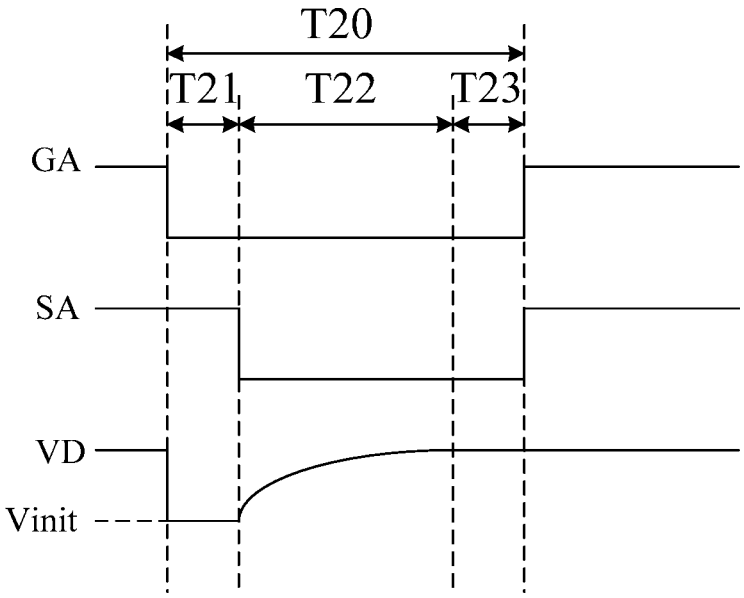
FIG. 2B is some other signal sequence diagrams in embodiments of the present disclosure.

The drive circuit as shown in FIG. 1 is taken as an example below, and the working process of the drive circuit provided by the embodiments of the present disclosure is described in combination with signal sequence diagrams as shown in FIG. 2A and FIG. 2B.

Specifically, the working process of the drive circuit provided by the embodiments of the present disclosure includes: a display period T10 and a detection period T20.

As shown in FIG. 2A, the display period T10 includes a data writing period T11 and a light emitting period T12. Moreover, in the display period T10, the detection signal end SA is a high-level signal all the time.

In the data writing period T11, due to the fact that the detection signal end SA is a high-level signal, the fifth transistor M5 and the sixth transistor M6 are both cut off. Due to the fact that the scanning signal end GA is a low-level signal, the first transistor M1 and the second transistor M2 may be controlled to be both conducted. Therefore, a data signal of the data detection end SD may be input into the gate electrode of the drive transistor M0, so that a voltage of the gate electrode of the drive transistor M0 is a voltage Vdata of the data signal, and the voltage is stored through the storage capacitor CST. In addition, a voltage of the first electrode of the voltage stabilizing capacitor CLC is also made to be the voltage Vdata of the data signal. In this way, a voltage difference between the first electrode of the voltage stabilizing capacitor CLC and the gate electrode of the drive transistor M0 may be made to be approximately zero, so that no voltage drop exists, the influence of a leakage current on the voltage of the gate electrode of the drive transistor M0 can be reduced, and the stability of the voltage of the gate electrode of the drive transistor M0 can be improved.

In the light emitting period T12, due to the fact that the detection signal end SA is the high-level signal, the fifth transistor M5 and the sixth transistor M6 are both cut off. Due to the fact that the scanning signal end GA is a high-level signal, the first transistor M1 and the second transistor M2 may be controlled to be both cut off. The drive transistor M0 is in a saturated state so as to generate a drive current Id for driving the light emitting device L to emit light, and, $Id=1/2K\ (Vdata-Vdd-Vth)^2$. Vdd is a voltage of the first power supply end ELVDD, and Vth is a threshold voltage of the drive transistor M0. Therefore, the light emitting device L is driven to emit light.

As shown in FIG. 2B, the detection period T20 includes a reset period T21, a charging period T22 and a sampling period T23.

In the reset period T21, due to the fact that the detection signal end SA is a high-level signal, the fifth transistor M5 and the sixth transistor M6 are both cut off. Due to the fact that the scanning signal end GA is a low-level signal, the first transistor M1 and the second transistor M2 may be controlled to be both conducted. Therefore, a reset signal of the data detection end SD may be input into the gate electrode of the drive transistor M0, so that a voltage of the gate electrode of the drive transistor M0 is a voltage Vinit of the reset signal, and the gate electrode of the drive transistor M0 is reset.

In the charging period T22, the data detection end SD is in a floating state, and due to the fact that the detection signal end SA is a low-level signal, the fifth transistor M5 and the sixth transistor M6 are both conducted. Due to the fact that the scanning signal end GA is a low-level signal, the first transistor M1 and the second transistor M2 may be controlled to be both conducted. Therefore, a voltage of the first power supply end ELVDD may charge the data detection end SD through the first transistor M1, the second transistor M2, the fifth transistor M5 and the sixth transistor M6. Charging is finished when the data detection end SD is charged to Vdd+Vth. It needs to be noted that charging time needs hundreds of microseconds to several milliseconds, and certainly, the charging time can be set according to actual application requirements, which is not limited here.

In the sampling period T23, due to the fact that the detection signal end SA is a low-level signal, the fifth transistor M5 and the sixth transistor M6 are both conducted. Due to the fact that the scanning signal end GA is a low-level signal, the first transistor M1 and the second transistor M2 may be controlled to be both conducted. A voltage of the data detection end SD is collected, and processing is performed according to the collected voltage of the data detection end SD so as to realize compensation for threshold voltage of the drive transistor M0.

Figure 3:
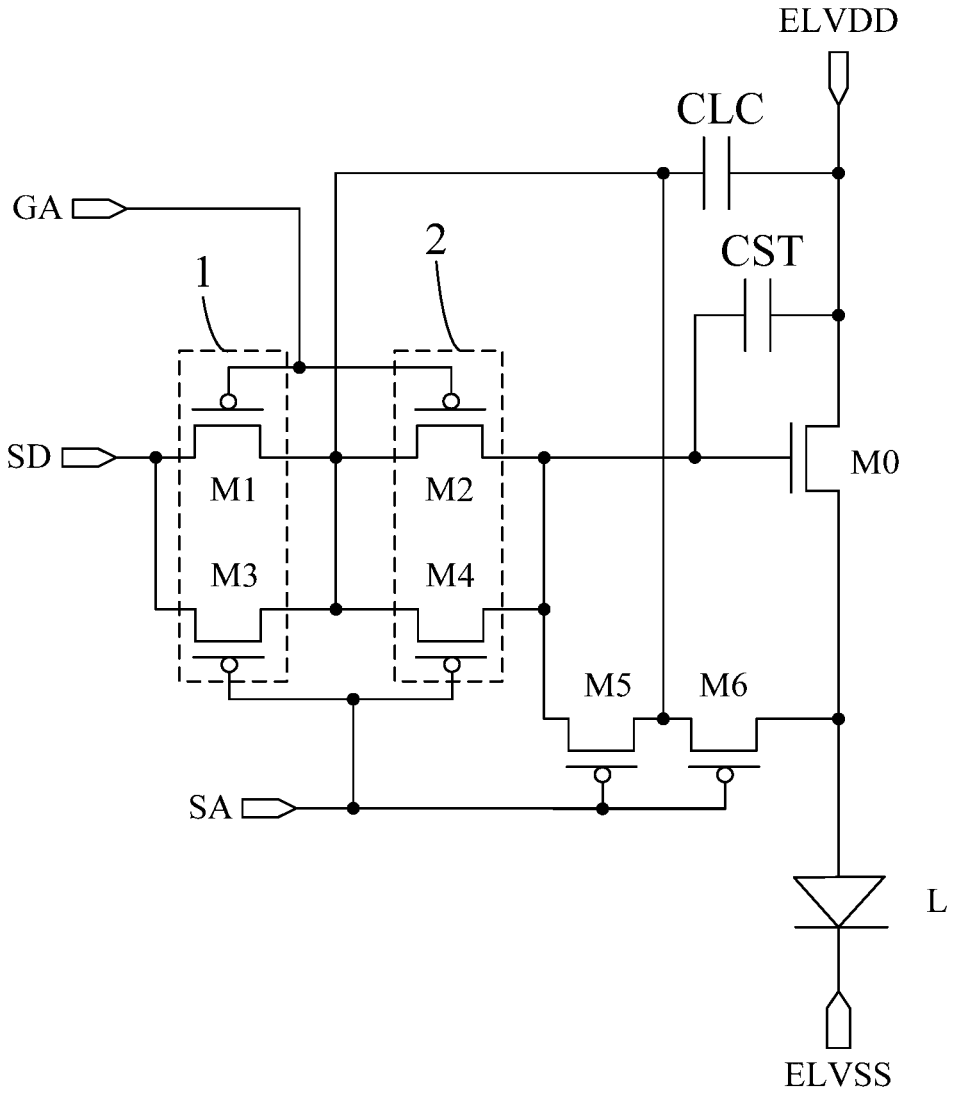
FIG. 3 is a schematic structural diagram of some other drive circuits in embodiments of the present disclosure.

Embodiments of the present disclosure further provide some array substrates, the schematic structural diagram of the array substrates is as shown in FIG. 3, and the array substrates are modified according to the implementation in the embodiments above. Only the difference between these embodiments and the above embodiments is illustrated below, and the same content is not repeated here.

In specific implementation, in the embodiments of the present disclosure, as shown in FIG. 3, the control signal end CS further includes: a detection signal end SA. Moreover, the first control circuit 1 further includes a third transistor M3. A first electrode of the third transistor M3 is electrically connected with the data detection end SD, a gate electrode of the third transistor M3 is electrically connected with the detection signal end SA, and a second electrode of the third transistor M3 is electrically connected with the first electrode of the voltage stabilizing capacitor CLC. The second control circuit 2 further includes a fourth transistor M4. A first electrode of the fourth transistor M4 is electrically connected with the first electrode of the voltage stabilizing capacitor CLC, a gate electrode of the fourth transistor M4 is electrically connected with the detection signal end SA, and a second electrode of the fourth transistor M4 is electrically connected with the gate electrode of the drive transistor M0.

The drive circuit as shown in FIG. 3 is taken as an example below, and the working process of the drive circuit provided by the embodiments of the present disclosure is described in combination with signal sequence diagrams as shown in FIG. 2A and FIG. 3.

As shown in FIG. 2A, the display period T10 includes the data writing period T11 and the light emitting period T12. Moreover, in the display period T10, the detection signal end SA is a high-level signal all the time, and the third transistor M3, the fourth transistor M4, the fifth transistor M5 and the sixth transistor M6 are all cut off. The working process of the drive circuit shown in FIG. 3 in the display period T10 may be basically the same as the working process of the drive circuit shown in FIG. 1 in the display period T10, which is not specifically repeated here.

Figure 4:
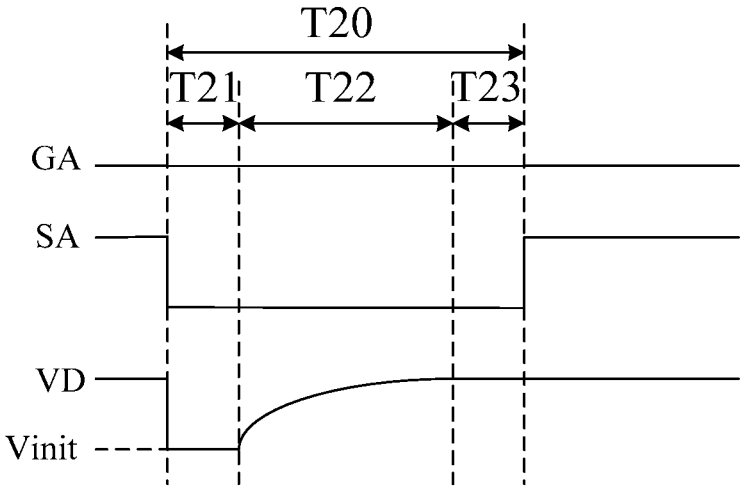
FIG. 4 is some other signal sequence diagrams in embodiments of the present disclosure.

As shown in FIG. 4, the detection period T20 includes the reset period T21, the charging period T22 and the sampling period T23. In the detection period T20, the scanning signal end GA is always a high-level signal, and the first transistor M1 and the second transistor M2 are both cut off.

In the reset period T21, due to the fact that the detection signal end SA is a low-level signal, the third transistor M3, the fourth transistor M4, the fifth transistor M5 and the sixth transistor M6 are all conducted. Therefore, a reset signal of the data detection end SD may be input into the gate electrode of the drive transistor M0, so that a voltage of the gate electrode of the drive transistor M0 is a voltage Vinit of the reset signal, and thus the gate electrode of the drive transistor M0 is reset.

In the charging period T22, the data detection end SD is in a floating state, and due to the fact that the detection signal end SA is a low-level signal, the third transistor M3, the fourth transistor M4, the fifth transistor M5 and the sixth transistor M6 are all conducted. Therefore, a voltage of the first power supply end ELVDD may charge the data detection end SD through the third transistor M3, the fourth transistor M4, the fifth transistor M5 and the sixth transistor M6. Charging is finished when the data detection end SD is charged to Vdd+Vth. It needs to be noted that charging time needs hundreds of microseconds to several milliseconds, and certainly, the charging time can be set according to actual application requirements, which is not limited here.

In the sampling period T23, due to the fact that the detection signal end SA is a low-level signal, the third transistor M3, the fourth transistor M4, the fifth transistor M5 and the sixth transistor M6 are all conducted. A voltage of the data detection end SD is collected, and processing is performed according to the collected voltage of the data detection end SD so as to realize compensation for threshold voltage of the drive transistor M0.

Based on the same inventive concept, embodiments of the present disclosure further provide some drive methods of the above drive circuit. The drive method includes: a display period T10 and a detection period T20; where the display period T10 includes a data writing period and a light emitting period; and the detection period T20 includes a reset period, a charging period and a sampling period.

Figure 5:
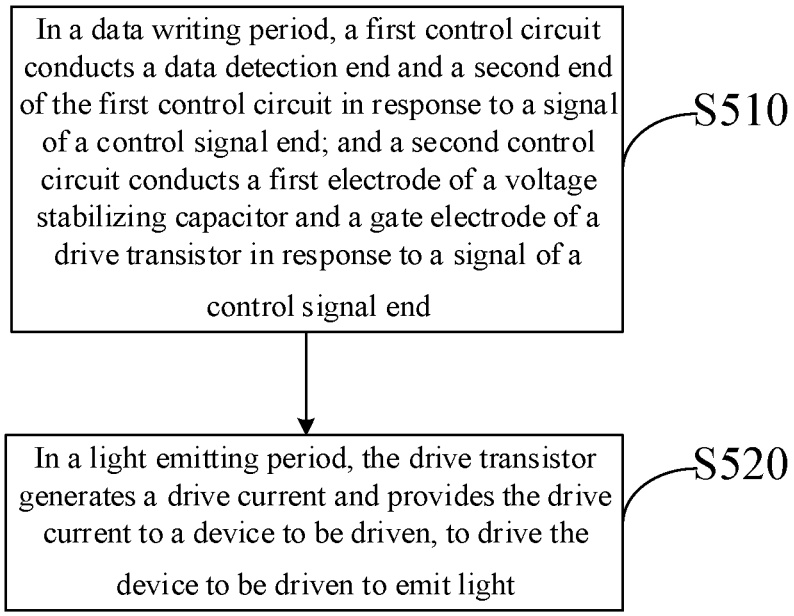
FIG. 5 is a flow chart of some drive methods of a drive circuit in embodiments of the present disclosure.

As shown in FIG. 5, the drive method of the drive circuit provided by the embodiments of the present disclosure includes the following steps.

S510, in the data writing period, a first control circuit conducts a data detection end and a second end of the first control circuit in response to a signal of a control signal end; and a second control circuit conducts a first electrode of a voltage stabilizing capacitor and a gate electrode of a drive transistor in response to a signal of a control signal end.

S520, in the light emitting period, the drive transistor generates a drive current and provides the drive current to a device to be driven, to drive the device to be driven to emit light.

It needs to be noted that the working process and the working principle of steps S510-S520 can refer to the working process of the drive circuit in the embodiments above, which is not repeated here.

Figure 6:
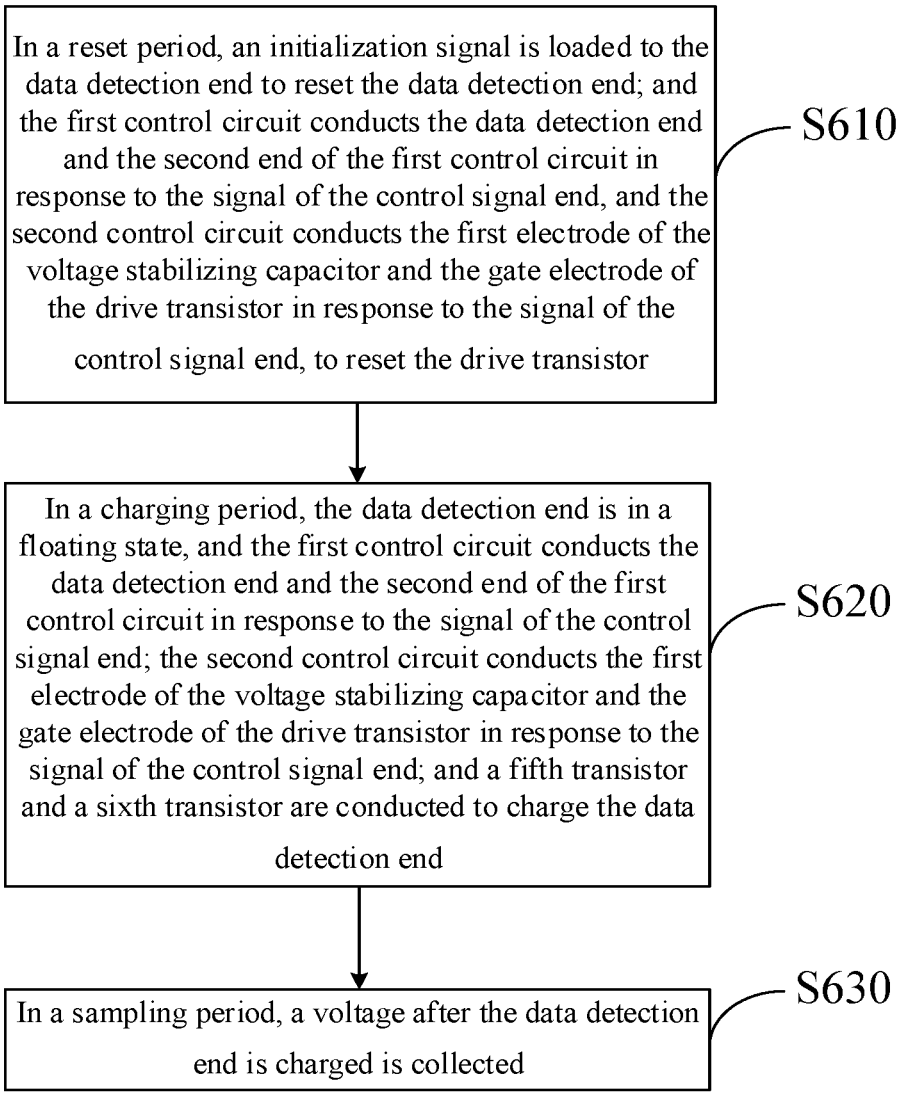
FIG. 6 is a flow chart of some other drive methods of a drive circuit in embodiments of the present disclosure.

As shown in FIG. 6, the drive method of the drive circuit provided by the embodiments of the present disclosure includes the following steps.

S610, in the reset period, an initialization signal is loaded to the data detection end to reset the data detection end; and the first control circuit conducts the data detection end and the second end of the first control circuit in response to the signal of the control signal end, and the second control circuit conducts the first electrode of the voltage stabilizing capacitor and the gate electrode of the drive transistor in response to the signal of the control signal end, to reset the drive transistor.

S620, in the charging period, the data detection end is in a floating state, and the first control circuit conducts the data detection end and the second end of the first control circuit in response to the signal of the control signal end; the second control circuit conducts the first electrode of the voltage stabilizing capacitor and the gate electrode of the drive transistor in response to the signal of the control signal end; and a fifth transistor and a sixth transistor are conducted to charge the data detection end.

S630, in the sampling period, a voltage after the data detection end is charged is collected.

It needs to be noted that the working process and the working principle of steps S610-S630 can refer to the working process of the drive circuit in the embodiments above, which is not repeated here.

Figure 7:
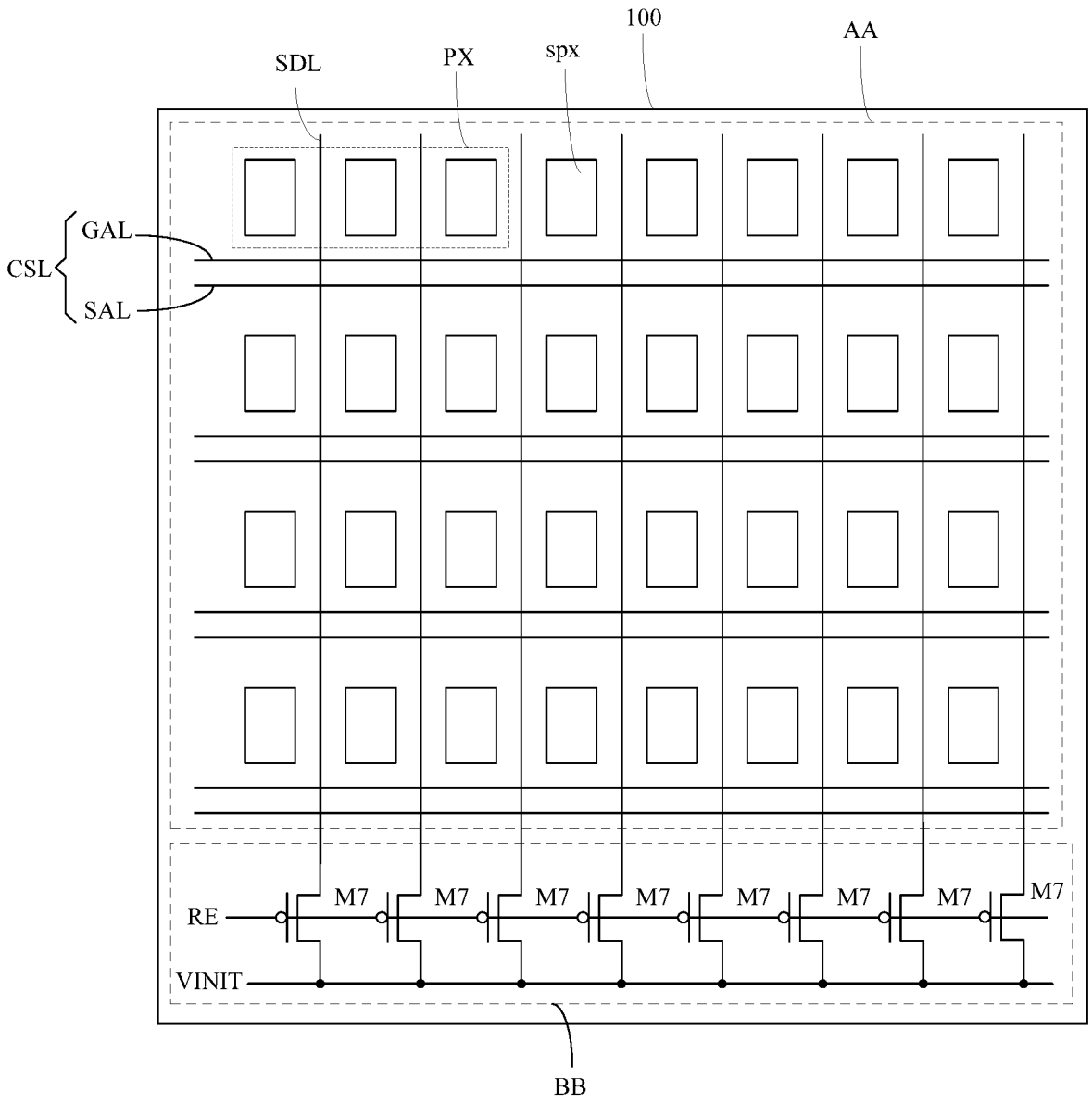
FIG. 7 is a schematic structural diagram of some display panels in embodiments of the present disclosure.

Based on the same inventive concept, embodiments of the present disclosure further provide some display panels. As shown in FIG. 7, the display panel includes: a base substrate 100, and a plurality of pixel units PX located in a display region AA of the base substrate 100. Each pixel unit PX may include a plurality of sub-pixels spx. Exemplarily, at least one of the plurality of sub-pixels includes a light emitting device and a drive circuit. A second electrode of a drive transistor M0 in the drive circuit is electrically connected with a first electrode of the light emitting device. It needs to be noted that the structure and the working principle of the drive circuit can refer to the embodiments above, which is not repeated here. Illustration is made below by taking the structure of the drive circuit shown in FIG. 3 as an example.

In specific implementation, in the embodiments of the present disclosure, each sub-pixel includes: a light emitting device and a drive circuit.

In specific implementation, in the embodiments of the present disclosure, as shown in FIG. 7, the display panel further includes: a plurality of control signal lines CSL and a plurality of data detection lines SDL located on the base substrate 100. Control signal ends CS of the drive circuits in one row of sub-pixels are correspondingly and electrically connected with at least one control signal line CSL, and data detection ends SD of the drive circuits in one column of sub-pixels are correspondingly and electrically connected with at least one data detection line SDL. Exemplary, the data detection ends SD of the drive circuits in one column of sub-pixels are correspondingly and electrically connected with one data detection line SDL.

In specific implementation, a control signal end CS includes a scanning signal end GA, and the specific implementation may refer to the embodiments shown in FIG. 1 and FIG. 3. In the embodiments of the present disclosure, in combination with FIG. 3, FIG. 7, and FIG. 8, the plurality of control signal lines CSL include: scanning signal lines GAL. The scanning signal ends GA of the drive circuits in one row of sub-pixels are correspondingly and electrically connected with one scanning signal line GAL. In other words, gate electrodes of first transistors M1 and second transistors M2 of the drive circuits in one row of sub-pixels are electrically connected with a corresponding scanning signal line GAL.

In specific implementation, a control signal end CS further includes: a detection signal end SA, and the specific implementation may refer to the embodiments shown in FIG. 1 and FIG. 3. In the embodiments of the present disclosure, in combination with FIG. 3, FIG. 7, and FIG. 8, the plurality of control signal lines CSL further include: detection signal lines SAL; and the detection signal ends SA of the drive circuits in one row of sub-pixels are correspondingly and electrically connected with one detection signal line SAL. In other words, gate electrodes of third transistors M3, fourth transistors M4, fifth transistors M5 and sixth transistors M6 of the drive circuits in one row of sub-pixels may all be electrically connected with a corresponding detection signal line SAL.

Figure 8:
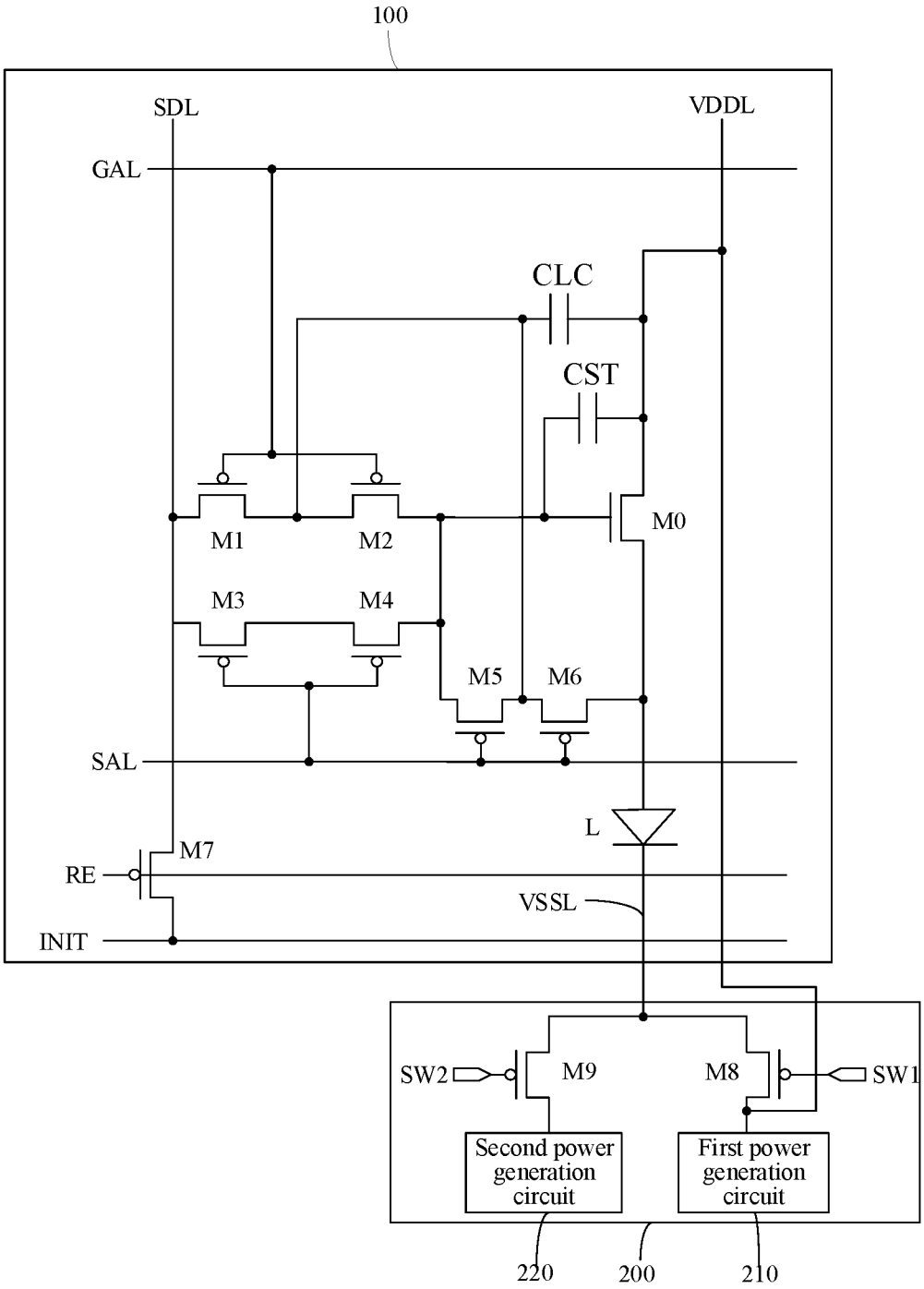
FIG. 8 is a specific schematic structural diagram of some display panels in embodiments of the present disclosure.

In specific implementation, in the embodiments of the present disclosure, in combination with FIG. 3, FIG. 7 and FIG. 8, the display panel further includes: a reset signal line RE, an initialization signal line INIT and a plurality of seventh transistors M7. One data detection line SDL corresponds to one seventh transistor M7. Moreover, gate electrodes of the plurality of seventh transistors M7 are all electrically connected with the reset signal line RE, first electrodes of the plurality of seventh transistors M7 are all electrically connected with the initialization signal line INIT, and a second electrode of each seventh transistor M7 is electrically connected with a corresponding data detection line SDL. Exemplary, the reset signal line RE, the initialization signal line INIT, and the plurality of seventh transistors M7 may be disposed in a non-display region BB. Certainly, in practical application, design can be carried out according to the practical application requirements, which is not limited here.

In specific implementation, in the embodiments of the present disclosure, in combination with FIG. 3, FIG. 7 and FIG. 8, the display panel further includes: a first power line VDDL, a second power line VSSL and a power management circuit 200. The first power line VDDL is electrically connected with a first power supply end ELVDD of the drive circuit, and the second power line VSSL is electrically connected with the second electrode of the light emitting device L. Moreover, the power management circuit 200 includes: a first power generation circuit 210, a second power generation circuit 220, an eighth transistor M8 and a ninth transistor M9. The first power generation circuit 210 is configured to generate a first voltage loaded to the first power supply end ELVDD, and the second power generation circuit 220 is configured to generate a second voltage loaded to a second power supply end ELVSS; and an output end of the first power generation circuit 210 is electrically connected with the first power line VDDL. A gate electrode of the eighth transistor M8 is electrically connected with a first selection signal end SW1, a first electrode of the eighth transistor M8 is electrically connected with the output end of the first power generation circuit 210, and a second electrode of the eighth transistor M8 is electrically connected with the second power line VSSL. A gate electrode of the ninth transistor M9 is electrically connected with a second selection signal end SW2, a first electrode of the ninth transistor M9 is electrically connected with an output end of the second power generation circuit 220, and a second electrode of the ninth transistor M9 is electrically connected with the second power line VSSL.

Exemplarily, the power management circuit 200 may be disposed in a drive integrated circuit (IC). Certainly, in practical application, design can be carried out according to the practical application requirements, which is not limited here.

The working process of the display panel provided by the embodiments of the present disclosure is described below in combination with the display panel shown in FIG. 7 and FIG. 8 and signal sequence diagrams shown in FIG. 9A and FIG. 9B. The working process of the drive circuit in one sub-pixel is taken as an example.

Specifically, the working process of the display panel provided by the embodiments of the present disclosure includes: a display period T10 and a detection period T20.

Figure 9A:
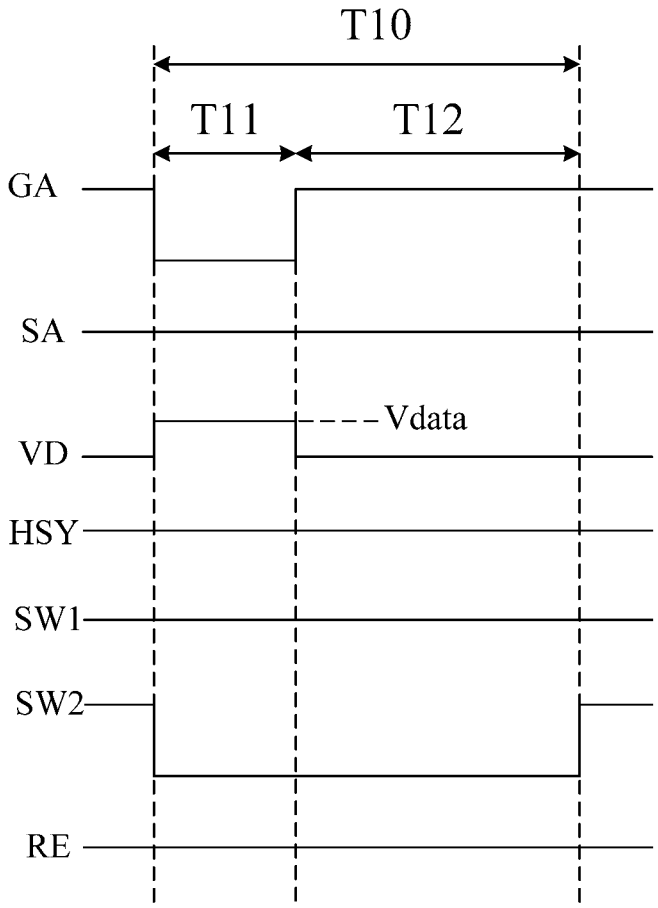
FIG. 9A is some signal sequence diagrams of a display panel in embodiments of the present disclosure.

As shown in FIG. 9A, the display period T10 includes a data writing period T11 and a light emitting period T12. Moreover, in the display period T10, a signal HSY for collecting a voltage on the data detection line SDL is controlled to be always at a high level, so that the working process of collecting the voltage on the data detection line SDL is not carried out in the display period T10. Moreover, a high-level signal is loaded to the detection signal line SAL all the time, a high-level signal is loaded to the first selection signal end SW1 all the time, a low-level signal is loaded to the second selection signal end SW2 all the time, and a high-level signal is loaded to the reset signal line RE all the time. Therefore, in the display period T10, the third transistor M3, the fourth transistor M4, the fifth transistor M5, the sixth transistor M6, the seventh transistor M7 and the eighth transistor M8 are all cut off.

In the data writing period T11, due to the fact that the detection signal line SAL is the high-level signal, the third transistor M3, the fourth transistor M4, the fifth transistor M5 and the sixth transistor M6 are all cut off. Due to the fact that the scanning signal line GAL is the low-level signal, the first transistor M1 and the second transistor M2 may be controlled to be both conducted. Therefore, a data signal of the data detection line SDL may be input into the gate electrode of the drive transistor M0, so that a voltage of the gate electrode of the drive transistor M0 is a voltage Vdata of the data signal. In addition, a voltage of the first electrode of the voltage stabilizing capacitor CLC is also made to be the voltage Vdata of the data signal. In this way, a voltage difference between the first electrode of the voltage stabilizing capacitor CLC and the gate electrode of the drive transistor M0 may be made to be approximately zero, so that no voltage drop exists, the influence of a leakage current on the voltage of the gate electrode of the drive transistor M0 can be reduced, and the stability of the voltage of the gate electrode of the drive transistor M0 can be improved.

In the light emitting period T12, due to the fact that the detection signal line SAL is the high-level signal, the fifth transistor M5 and the sixth transistor M6 are both cut off. Due to the fact that the scanning signal end GA is a high-level signal, the first transistor M1 and the second transistor M2 may be controlled to be both cut off. The drive transistor M0 is in a saturated state so as to generate a drive current Id for driving the light emitting device L to emit light, so that the light emitting device emits light. And, $Id=1/2K\ (Vdata-Vdd-Vth)^2$, Vdd is a voltage of the first power supply end ELVDD, and Vth is a threshold voltage of the drive transistor M0.

Figure 9B:
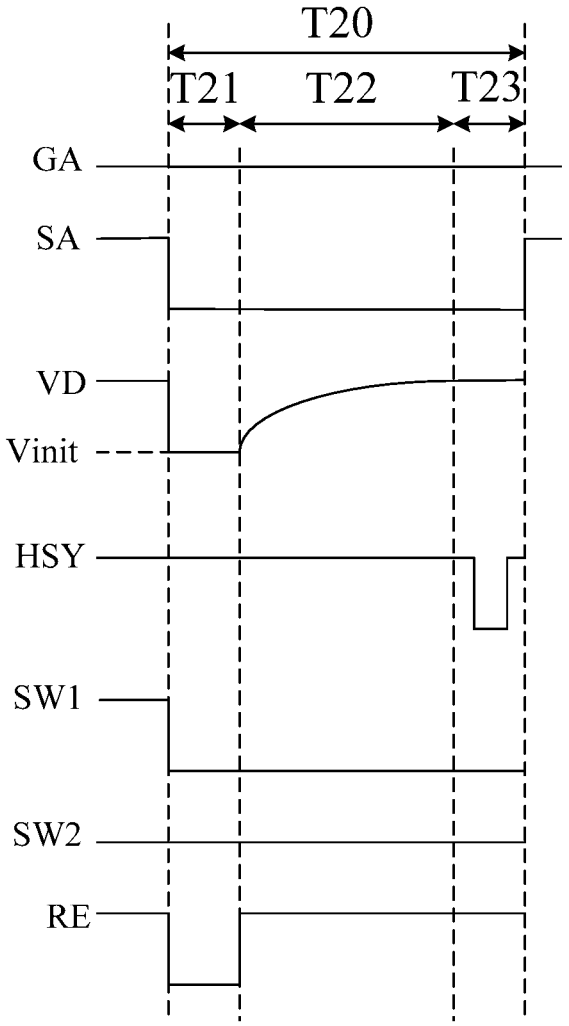
FIG. 9B is some signal sequence diagrams of a display panel in embodiments of the present disclosure.

As shown in FIG. 9B, the detection period T20 includes a reset period T21, a charging period T22 and a sampling period T23. Moreover, in the detection period T20, a high-level signal is loaded to the scanning signal line GAL all the time, a high-level signal is loaded to the second selection signal end SW2 all the time, and a low-level signal is loaded to the first selection signal end SW1 all the time. Therefore, in the detection period T20, the first transistor M1, the second transistor M2 and the ninth transistor M9 are all cut off.

In the reset period T21, due to the fact that a signal transmitted on the reset signal line RE is a low-level signal, the seventh transistor M7 is conducted to input a reset signal transmitted on the initialization signal line INIT into the data detection line SDL. Due to the fact that the detection signal line SAL is the low-level signal, the third transistor M3, the fourth transistor M4, the fifth transistor M5 and the sixth transistor M6 are all conducted. The first transistor M1 and the second transistor M2 may be controlled to be both conducted. Therefore, a reset signal of the data detection line SDL may be input into the gate electrode of the drive transistor M0, so that a voltage of the gate electrode of the drive transistor M0 is a voltage Vinit of the reset signal, and thus the gate electrode of the drive transistor M0 is reset.

In the charging period T22, due to the fact that a signal transmitted on the reset signal line RE is a high-level signal, the seventh transistor M7 is cut off, and the data detection line SDL is in a floating state. Due to the fact that the detection signal line SAL is the low-level signal, the third transistor M3, the fourth transistor M4, the fifth transistor M5 and the sixth transistor M6 are all conducted. Therefore, a voltage of the first power supply end ELVDD may charge the data detection line SDL through the third transistor M3, the fourth transistor M4, the fifth transistor M5 and the sixth transistor M6. Charging is finished when the data detection line SDL is charged to Vdd+Vth. It needs to be noted that charging time needs hundreds of microseconds to several milliseconds, and certainly, the charging time can be set according to actual application requirements, which is not limited here.

In the sampling period T23, due to the fact that the detection signal line SAL is the low-level signal, the third transistor M3, the fourth transistor M4, the fifth transistor M5 and the sixth transistor M6 are all conducted. A signal HSY for collecting a voltage on the data detection line SDL is controlled to be at a low level, so that in the sampling period T23, the voltage on the data detection line SDL may be controlled to be collected, and processing is performed according to the collected voltage on the data detection line SDL so as to realize compensation for threshold voltage of the drive transistor M0.

Based on the same inventive concept, embodiments of the present disclosure further provide a display apparatus, including the display panel provided by the embodiments of the present disclosure. The principle of the display apparatus for solving the problem is similar to that of the aforementioned display panel, so that the implementation of the display apparatus can refer to the implementation of the aforementioned display panel, and repetitions are omitted here.

In specific implementation, in the embodiments of the present disclosure, the display apparatus may be: any product or part with a display function, such as a mobile phone, a tablet computer, a television, a display, a notebook computer, a digital photo frame, a navigator and the like. It should be understood by a person of ordinary skill in the art that the display device should have other essential constituent parts, which is not repeated here and may also not be regarded as limitation to the present disclosure.

According to the drive circuit, the drive method, the display panel and the display apparatus provided by the embodiments of the present disclosure, the first control circuit is configured to conduct the data detection end and the second end of the first control circuit in response to the signal of the control signal end; and the second control circuit is configured to conduct the first electrode of the voltage stabilizing capacitor and the gate electrode of the drive transistor in response to the signal of the control signal end. Moreover, by arranging the voltage stabilizing capacitor, a leakage current of the transistor can be stored in the voltage stabilizing capacitor by utilizing a charge storage effect of the voltage stabilizing capacitor, so that a voltage difference between the first electrode of the voltage stabilizing capacitor and the data detection end can be reduced, and the leakage current is further reduced. Moreover, a voltage of the first electrode of the voltage stabilizing capacitor and a voltage of the gate electrode of the drive transistor may be made approximately the same in the light emitting period, so that the voltage difference between the first electrode of the voltage stabilizing capacitor and the gate electrode of the drive transistor is approximately zero, the influence of the leakage current on the voltage of the gate electrode of the drive transistor can be further reduced, and the voltage stability of the gate electrode of the drive transistor is further improved.

Although the preferred embodiments of the present disclosure have been described, those skilled in the art can make additional modifications and variations on these embodiments once they know the basic creative concept. Therefore, the appended claims are intended to be explained as including the preferred embodiments and all modifications and variations falling within the scope of the present disclosure.

Obviously, those skilled in the art can make various modifications and variations to the embodiments of the present disclosure without departing from the spirit and scope of the present disclosure. In this way, if these modifications and variations of the embodiments of the present disclosure fall within the scope of the claims of the present disclosure and their equivalents, the present disclosure is also intended to include these modifications and variations.

What is claimed is:

1. A drive circuit, comprising:

a drive transistor, wherein a first electrode of the drive transistor is electrically connected with a first power supply end, and a second electrode of the drive transistor is electrically connected with a device to be driven;

a first control circuit, wherein a first end of the first control circuit is electrically connected with a data detection end, and a control end of the first control circuit is electrically connected with a control signal end; and the first control circuit is configured to conduct the data detection end and a second end of the first control circuit in response to a signal of the control signal end;

a voltage stabilizing capacitor, wherein a first electrode of the voltage stabilizing capacitor is electrically connected with the second end of the first control circuit, and a second electrode of the voltage stabilizing capacitor is electrically connected with the first power supply end; and a second control circuit, wherein a first end of the second control circuit is electrically connected with the first electrode of the voltage stabilizing capacitor, a second end of the second control circuit is electrically connected with a gate electrode of the drive transistor, and a control end of the second control circuit is electrically connected with the control signal end; and the second control circuit is configured to conduct the first electrode of the voltage stabilizing capacitor and the gate electrode of the drive transistor in response to a signal of the control signal end;

wherein the control signal end comprises: a scanning signal end and a detection signal end;

the first control circuit comprises a first transistor; wherein a first electrode of the first transistor is electrically connected with the data detection end, a gate electrode of the first transistor is electrically connected with the scanning signal end, and a second electrode of the first transistor is electrically connected with the first electrode of the voltage stabilizing capacitor;

the second control circuit comprises a second transistor; wherein a first electrode of the second transistor is electrically connected with the first electrode of the voltage stabilizing capacitor, a gate electrode of the second transistor is electrically connected with the scanning signal end, and a second electrode of the second transistor is electrically connected with the gate electrode of the drive transistor;

the first control circuit further comprises a third transistor; wherein a first electrode of the third transistor is electrically connected with the data detection end, a gate electrode of the third transistor is electrically connected with the detection signal end, and a second electrode of the third transistor is electrically connected with the first electrode of the voltage stabilizing capacitor; and the second control circuit further comprises a fourth transistor; wherein a first electrode of the fourth transistor is electrically connected with the first electrode of the voltage stabilizing capacitor, a gate electrode of the fourth transistor is electrically connected with the detection signal end, and a second electrode of the fourth transistor is electrically connected with the gate electrode of the drive transistor.

2. The drive circuit according to claim 1, wherein the drive circuit further comprises:

a fifth transistor, wherein a gate electrode of the fifth transistor is electrically connected with the detection signal end, and a first electrode of the fifth transistor is electrically connected with the gate electrode of the drive transistor; and a sixth transistor, wherein a gate electrode of the sixth transistor is electrically connected with the detection signal end, a first electrode of the sixth transistor is electrically connected with a second electrode of the fifth transistor, and a second electrode of the sixth transistor is electrically connected with the second electrode of the drive transistor.

3. The drive circuit according to claim 1, wherein the drive circuit further comprises:

a storage capacitor, wherein a first electrode of the storage capacitor is electrically connected with the gate electrode of the drive transistor, and a second electrode of the storage capacitor is electrically connected with the first power supply end.

4. A display panel, comprising:

a base substrate;

a plurality of sub-pixels, arranged on the base substrate; wherein at least one of the plurality of sub-pixels comprises a light emitting device and the drive circuit according to claim 1; wherein the second electrode of the drive transistor in the drive circuit is electrically connected with a first electrode of the light emitting device;

a plurality of control signal lines, arranged on the base substrate, wherein control signal ends of drive circuits in one row of sub-pixels is correspondingly and electrically connected with at least one of the plurality of control signal lines; and a plurality of data detection lines, arranged on the base substrate, wherein data detection ends of drive circuits in one column of sub-pixels is correspondingly and electrically connected with at least one of the plurality of data detection lines.

5. The display panel according to claim 4, wherein the plurality of control signal lines comprise: scanning signal lines; and scanning signal ends of the drive circuits in one row of sub-pixels is correspondingly and electrically connected with one of the scanning signal lines.

6. The display panel according to claim 5, wherein the plurality of control signal lines further comprise: detection signal lines; and detection signal ends of the drive circuits in one row of sub-pixels is correspondingly and electrically connected with one of the detection signal lines.

7. The display panel according to claim 4, wherein the display panel further comprises:

a reset signal line;

an initialization signal line; and a plurality of seventh transistors, wherein one of the plurality of data detection lines corresponds to one of the plurality of seventh transistors; wherein gate electrodes of the plurality of seventh transistors are electrically connected with the reset signal line, first electrodes of the plurality of seventh transistors are electrically connected with the initialization signal line, and a second electrode of each of the plurality of seventh transistors is electrically connected with a corresponding data detection line.

8. The display panel according to claim 4, wherein the display panel further comprises:

a first power line, electrically connected with a first power supply end of the drive circuit;

a second power line, electrically connected with a second electrode of the light emitting device; and a power management circuit, comprising: a first power generation circuit, a second power generation circuit, an eighth transistor and a ninth transistor; wherein the first power generation circuit is configured to generate a first voltage loaded to the first power supply end, and the second power generation circuit is configured to generate a second voltage loaded to a second power supply end;

wherein an output end of the first power generation circuit is electrically connected with the first power line;

a gate electrode of the eighth transistor is electrically connected with a first selection signal end, a first electrode of the eighth transistor is electrically connected with the output end of the first power generation circuit, and a second electrode of the eighth transistor is electrically connected with the second power line; and a gate electrode of the ninth transistor is electrically connected with a second selection signal end, a first electrode of the ninth transistor is electrically connected with an output end of the second power generation circuit, and a second electrode of the ninth transistor is electrically connected with the second power line.

9. A display apparatus, comprising the display panel according to claim 4.

10. A drive method of the drive circuit according to claim 1, comprising: a display period and a detection period;

wherein the display period comprises a data writing period and a light emitting period; wherein in the data writing period, the first control circuit conducts the data detection end and the second end of the first control circuit in response to the signal of the control signal end; and the second control circuit conducts the first electrode of the voltage stabilizing capacitor and the gate electrode of a drive transistor in response to the signal of the control signal end; and in the light emitting period, the drive transistor generates a drive current and provides the drive current to a device to be driven, to drive the device to be driven to emit light;

wherein the detection period comprises a reset period, a charging period and a sampling period; wherein in the reset period, an initialization signal is loaded to the data detection end to reset the data detection end; and the first control circuit conducts the data detection end and the second end of the first control circuit in response to the signal of the control signal end, and the second control circuit conducts the first electrode of the voltage stabilizing capacitor and the gate electrode of the drive transistor in response to the signal of the control signal end, to reset the drive transistor;

in the charging period, the data detection end is in a floating state, and the first control circuit conducts the data detection end and the second end of the first control circuit in response to the signal of the control signal end; the second control circuit conducts the first electrode of the voltage stabilizing capacitor and the gate electrode of the drive transistor in response to the signal of the control signal end; and a fifth transistor and a sixth transistor are conducted to charge the data detection end; and in the sampling period, a voltage after the data detection end is charged is collected.

* * * * *